US006269837B1

(12) United States Patent
Arent et al.

(10) Patent No.: US 6,269,837 B1
(45) **Date of Patent: *Aug. 7, 2001**

(54) RECHARGEABLE DISPENSING SYSTEM

(75) Inventors: Lee Mathew Arent, Fairfield; Chinto Benjamin Gaw, Cincinnati, both of OH (US); Reuben Earl Oder, Union, KY (US); Robert Edward Stahley, Middletown, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/188,655

(22) Filed: Nov. 9, 1998

(51) Int. Cl.[7] ..... F16K 51/00

(52) U.S. Cl. ..... 137/614.04; 222/325; 222/380; 222/501; 251/149.6

(58) Field of Search ..... 222/153.09, 325–372, 222/380–507; 141/346, 348, 349, 351, 354, 364, 383, 384; 137/268, 614.04; 251/149.6, 11

(56) References Cited

U.S. PATENT DOCUMENTS

| | | | | |
|---|---|---|---|---|
| 2,258,637 | * | 10/1941 | Young et al. | 222/372 X |
| 3,237,809 | * | 3/1966 | Daragan et al. | 222/325 |
| 3,568,736 | * | 3/1971 | Linch et al. | 137/614.04 X |
| 3,972,387 | * | 8/1976 | Braun | 137/614.04 X |
| 4,137,930 | * | 2/1979 | Scholle | 137/614.04 X |
| 4,408,701 | * | 10/1983 | Jeans | 222/507 X |
| 4,456,152 | * | 6/1984 | Young et al. | 222/372 X |
| 4,457,455 | | 7/1984 | Meshberg | 222/105 |
| 4,493,440 | | 1/1985 | Von Buelow et al. | 222/109 |
| 4,673,109 | | 6/1987 | Cassia | 222/153 |
| 4,749,108 | | 6/1988 | Dornbusch et al. | 222/212 |
| 4,948,014 | | 8/1990 | Rutter et al. | 222/83 |
| 5,005,737 | | 4/1991 | Rohr | 222/212 |
| 5,029,624 | * | 7/1991 | McCunn et al. | 141/364 X |
| 5,060,701 | * | 10/1991 | McCunn et al. | 137/614.04 X |
| 5,115,950 | | 5/1992 | Rohr | 222/490 |
| 5,242,085 | | 9/1993 | Richter et al. | 222/105 |
| 5,255,713 | | 10/1993 | Scholle et al. | 137/614.04 |
| 5,271,531 | | 12/1993 | Rohr et al. | 222/212 |
| 5,273,186 | | 12/1993 | Widmer | 222/50 |
| 5,348,192 | | 9/1994 | Sardynski et al. | 222/129 |
| 5,425,404 | * | 6/1995 | Dyer | 222/325 X |
| 5,480,068 | * | 1/1996 | Frazier et al. | 222/325 X |
| 5,494,194 | | 2/1996 | Topper et al. | 222/146.6 |
| 5,556,005 | * | 9/1996 | Banks | 222/325 X |
| 5,641,012 | * | 6/1997 | Silversides | 141/346 X |

FOREIGN PATENT DOCUMENTS 0 434 126A1 1/1991 (EP) .

* cited by examiner

*Primary Examiner*—Kevin Shaver
*Assistant Examiner*—John Bastianelli
(74) *Attorney, Agent, or Firm*—C. Brant Cook; Kim William Zerby; Steven W. Miller

(57) ABSTRACT

A rechargeable dispensing system for dispensing a liquid product has a recharge container, a platform base, a locking mechanism, and a pump. The recharge container has a primary finish and a valve. The base has a receptacle for receiving the primary finish of the recharge container and a fluid connector located within the base and attached to the receptacle. The locking mechanism secures the recharge container to the base, wherein the valve is in a closed position when the locking mechanism is engaged and in an open position when the locking mechanism is disengaged. The pump is attached to the base in open communication with the recharge container along the fluid connector for dispensing the liquid product from the recharge container.

18 Claims, 8 Drawing Sheets

21a
21c
21
21b
19
30
38
36
38
38
22
12
35
37

RECHARGEABLE DISPENSING SYSTEM

FIELD OF THE INVENTION

The present invention relates to a rechargeable dispensing system, and more particularly, to a rechargeable laundry treatment dispensing system for accurately dispensing relatively large doses of a highly viscous liquid, and more particularly, for dispensing an anhydrous thick cream-like product having at least 40% suspended solids with minimal effort and with minimal residual left within the dispensing container.

BACKGROUND OF THE INVENTION

Traditional laundry cleaning packaging consists of a variety of configurations. For granular detergents, the most common packaging is a paperboard carton with a scoop dispenser. For liquid detergents, there are several conventional packaging configurations including a bottle having a dosing cap, a squeeze bottle with top-mounted nozzle, a bottle having a top-mounted dip tube piston pump or sprayer and a refillable package.

For liquid detergents, the use of a scoop is very messy, particularly for a new type of anhydrous (solvent-based) thick cream-like laundry detergent product having at least 40% suspended solids and a specific gravity of 1.2 which is too thick to pour accurately using most conventional packaging. In sizes greater than 1.5 liter, the combination of the large volume and the product's weight make a squeeze bottle non-feasible for the thick cream-like product because it is too heavy to lift and simultaneously squeeze through a nozzle. Furthermore, the highly viscous product is expensive and cannot be exposed to water prior to use.

The top-mounted, dip tube piston pump dispenser is more feasible to use than squeezing or pouring different types of liquid detergent because it permits the user to accurately dispense the product without lifting the dispenser. However, the top-mounted, dip tube pump is undesirable for at least two reasons. First, the dip tube leaves product residuals at the bottom of the container, thus wasting product and enticing the user to introduce water into the container to remove the residual. Second, due to the properties of the highly viscous product, the product adheres to all conventional packaging materials.

For example, regarding the top-mounted, dip tube piston pump, the product will adhere to the dip tube and container causing product waste. Furthermore, this type of package requires either additional pump strokes to prime the pump or significant force by the user to dispense the required dose of the highly viscous product due to the product's adherence to the inside of the dip tube. Furthermore, due to the cost of a piston pump dispenser, it is advantageous to have a dispenser which reuses the dispenser while the liquid filled container is replaced.

Therefore, what is needed is a rechargeable dispenser capable of accurately dispensing relatively large doses of a highly viscous anhydrous product having at least 40% suspended solids with minimal effort and with minimal residual left within the container while reducing the possibility of water contamination.

SUMMARY OF THE INVENTION

It is an object of the present invention to provide an improved rechargeable dispensing system.

It is a further object to provide a rechargeable dispensing system for dispensing a liquid product, comprising a recharge container having a primary finish and a valve, a base having a receptacle for receiving the primary finish of the recharge container and a fluid connector located within the base and attached to the receptacle, a locking mechanism for securing the recharge container to the base, wherein the valve is in a closed position when the locking mechanism is engaged and the valve is in an open position when the locking mechanism is disengaged, and a pump attached to the base in open communication with the recharge container along the fluid connector for dispensing the liquid product from the recharge container.

DETAILED DESCRIPTION OF THE INVENTION

Figure 1:
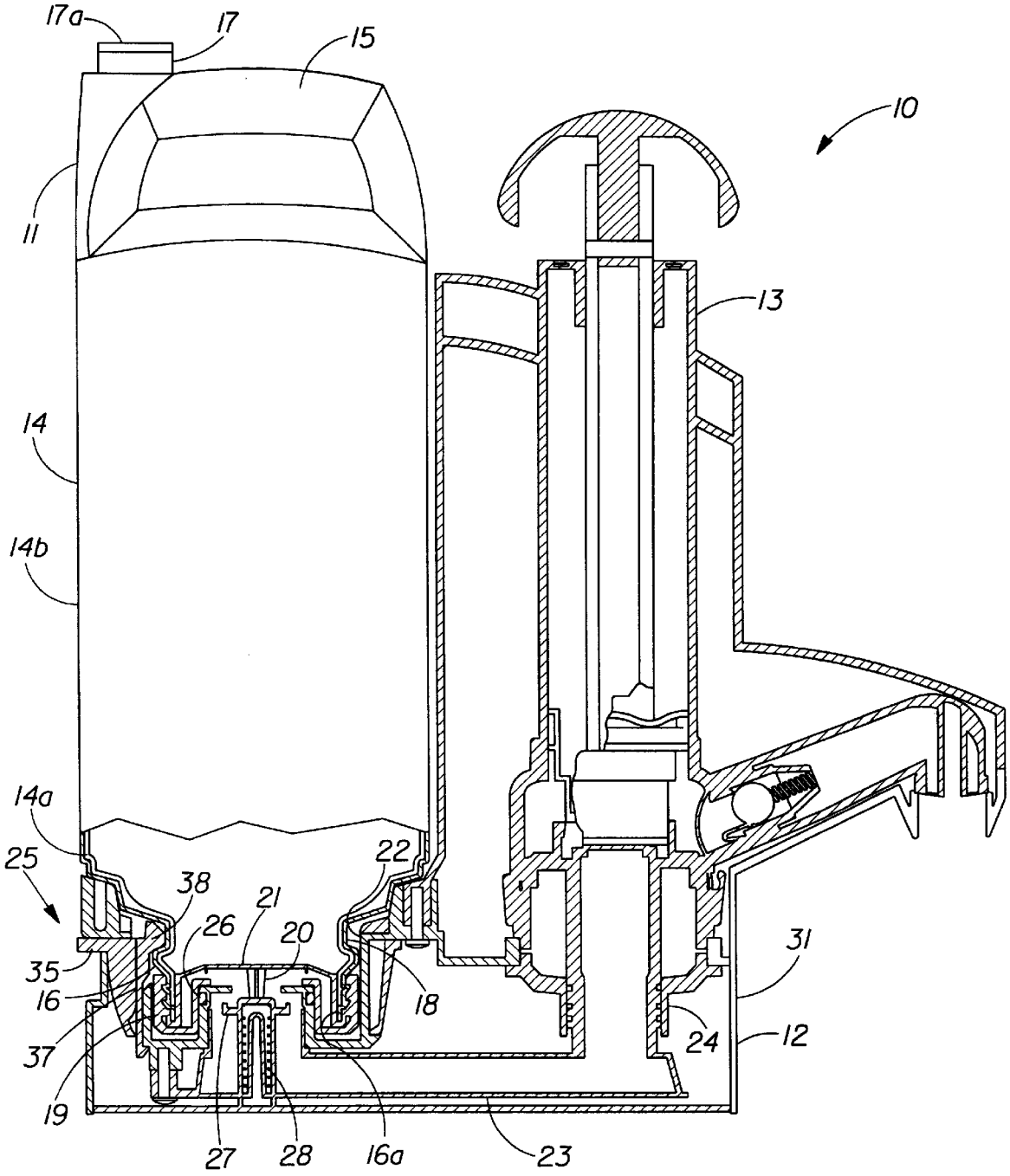
FIG. 1 is a cross-sectional view of the preferred rechargeable dispensing system according to the preferred embodiment of the present invention.
Figure 2:
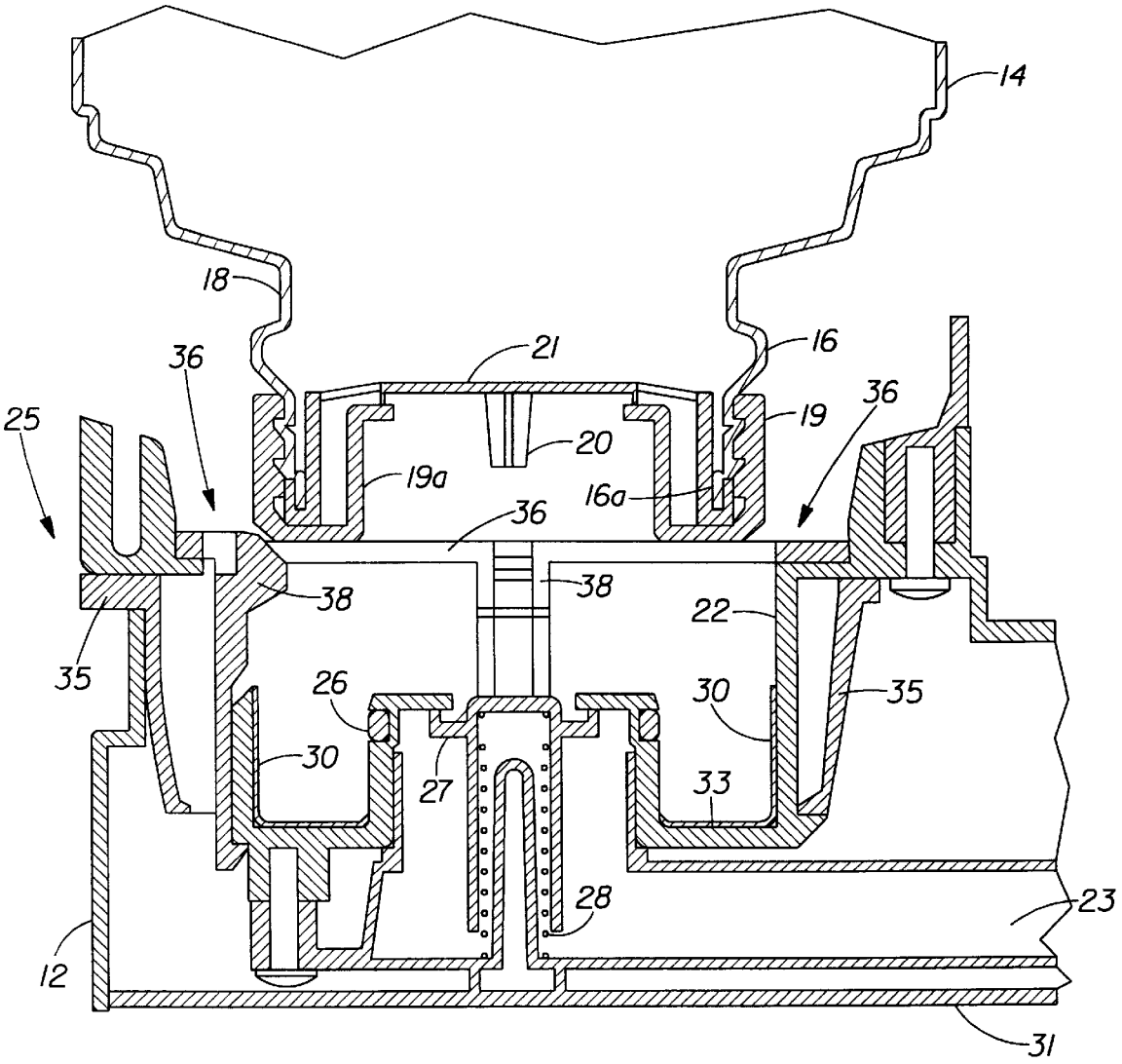
FIG. 2 is a partial cross-sectional view of the preferred rechargeable dispensing system having a valved base in an undocked state according to the present invention.

Referring to FIGS. 1 and 2, the preferred rechargeable dispensing system 10 is shown in the docked (FIG. 1) and undocked (FIG. 2) position and includes three major subassemblies: a recharge container assembly 11, a base assembly 12, and a piston pump assembly 13. The rechargeable dispensing system 10 is in a docked position when the recharge container 11 is engaged with the base 12 while the system 10 is in an undocked position when the recharge container 11 is disengaged with the base 12.

The preferred recharge container 11 comprises a blow molded bottle 14 having a handle 15, a primary finish 16 having an opening 16*a* and a finish recess 18 located at one end of the bottle 14, a secondary finish 17 located at the opposite end of the bottle 14 for venting through a venting cap 17*a*, a bottle cap 19 for supporting a valve post 20 which is attached to a valve 21. Alternately, the recharge container 11 may comprise a flexible bag 14*a*, the bag 14*a* in a carton, or the bag 14*a* in the bottle 14 without deviating from the intent of the invention.

The bottle 14 is designed to house a highly viscous anhydrous liquid product having at least 40% suspended solids and is preferably blow molded. However, the bottle may contain a variety of liquids and may comprise a variety of materials formed using various methods such as a heat sealed, gusseted plastic pouch or a blow molded bag positioned within a blow molded bottle without deviating from the present invention.

The handle 15 of the bottle 14 is preferably positioned at the opposite end of the primary finish 16 for transporting the dispensing system 10 when the recharge container 11 is docked or for transporting the recharge container 11 when undocked from the base 12. The handle 15 can also be used to ergonomically assist the placement of the recharge container 11 in the base 12 during the docking process. Alternatively, the handle 15 may be positioned adjacent the primary finish 16 or along the sides 14*b* of the bottle 14 without deviating from the intent of the invention.

The primary finish 16 secures the recharge container 11 to the base 12 and allows the contents of the bottle 14 to exit into the base 12. The bottle cap 19 provides a sealing surface 19*a* for a seal 26. The valve 21 is used to retain the product within the recharge container 11 until it is docked within the base 12. The valve 21 is preferably a spiral valve (FIG. 3) but may comprise a variety of valve configurations without deviating from the intent of the invention.

Figures 3A, 3B:
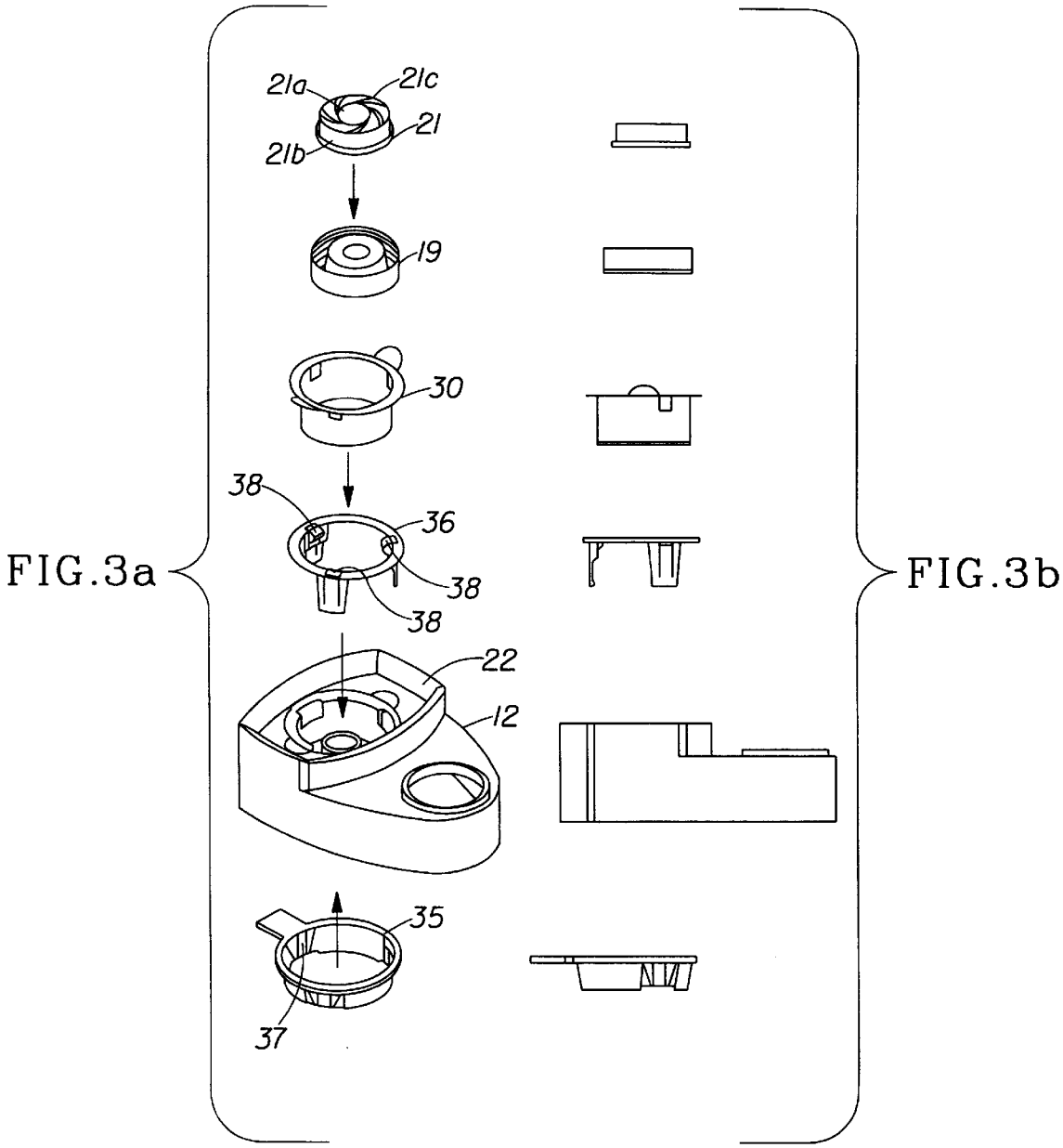
FIGS. 3*a* and 3*b* are partial exploded perspective and side view assembly drawings, respectively, of the preferred locking mechanism according to the present invention.

The valve post 20 is used to open the spiral valve 21 by pushing against a base seal 27 of the base 12 when the recharge container 11 is pushed vertically into the docked position (FIG. 1). The preferred spiral valve 21, as shown in FIG. 3*a*, has a plate 21 a connected to an outer ring 21*b* with preferably between 3–10 bands 21*c* having shape memory. In the preferred embodiment, the spiral valve 21 is seated against the bottle cap 19 and is opened by the valve post 20 which pushes against the plate 21*a* of the spiral valve 21 when docked. As the post 20 engages the plate 21*a*, the bands 21*c* flex as the plate 21*a* is pushed upward into an open position within the bottle 14. As a result, the contents of the bottle 14 will pass into the receptacle 22 and to the connector 23 due to gravity.

When the recharge container 11 is removed from the receptacle 22, the post 20 will disengage the plate 21*a* which allows the bands 21*c* to return to their original closed position due to their shape memory. In turn, the bands 21*c* pull the plate 21*a* back against the top surface of the bottle cap 19. In this way, the recharge container 11 can be removed in the inverted position without the contents of the bottle leaking.

In addition, the locking mechanism 25 preferably activates the spiral valve 21 by manipulating the post 20 so that the spiral valve 21 remains in its closed position when the recharge container 11 is in the docked but unlocked position. The spiral valve 21 preferably opens only when the recharge container 11 is in the docked and locked position by engaging the locking mechanism 25.

The secondary finish 17 is used as an air exit for the vent cap 17*a*, which preferably has a one-way vent valve, as product is dispensed from the bottle 14. The vent cap 17*a* is preferably loosened to relieve the vacuum created within the bottle 14. Without the vent cap 17*a*, the bottle 14 will collapse as the product is dispensed. This is advantageous in an alternate embodiment of the rechargeable dispensing system 10 which reduces product residuals within the bottle 14 by pulling the bottle's flexible walls 14*b* together and squeezing the product out of the bottle 14.

The preferred base 12 has a receptacle 22 for receiving the primary finish 16 of the recharge container 11, a fluid connector 23 for connecting the receptacle 22 to a pump inlet 24 located within the base 12 and a locking mechanism 25 for securing the recharge container 11 to the base 12. The preferred base 12 also has the seal 26, the base seal 27, a return spring 28, a drip cup 30 and a base cover 31. The seal 26, preferably an O-ring, is attached to the receptacle 22 and provides a liquid-tight seal between the recharge container 11 and the base 12. The drip cup 30 is removably attached to an inside bottom surface 33 of the receptacle 22 for receiving any excess product which may drip from the bottle 14 prior to sealing the recharge container 11 to the base 12. Finally, the base cover 31 encloses the internal parts of the base 12 to create the appearance of a solid base.

Referring to FIGS. 3*a* and 3*b*, the preferred locking mechanism 25 comprises a clip actuator 35 and a finger ring 36 both of which are attached to the base 12. The preferred clip actuator 35 has three camming surfaces 37 approximately 120 degrees apart. The preferred finger ring 36 has three fingers 38 and is made of polypropylene. The clip actuator 35 snaps inside the receptacle 22 and the finger ring 36 is then snapped inside of the clip actuator 35 as shown in FIGS. 1 and 2. The clip actuator 35 and the finger ring 36 may have one or more camming surfaces 37, one or more fingers 38, respectively, and/or be made of a variety of materials without deviating from the intent of the invention.

Figure 4:
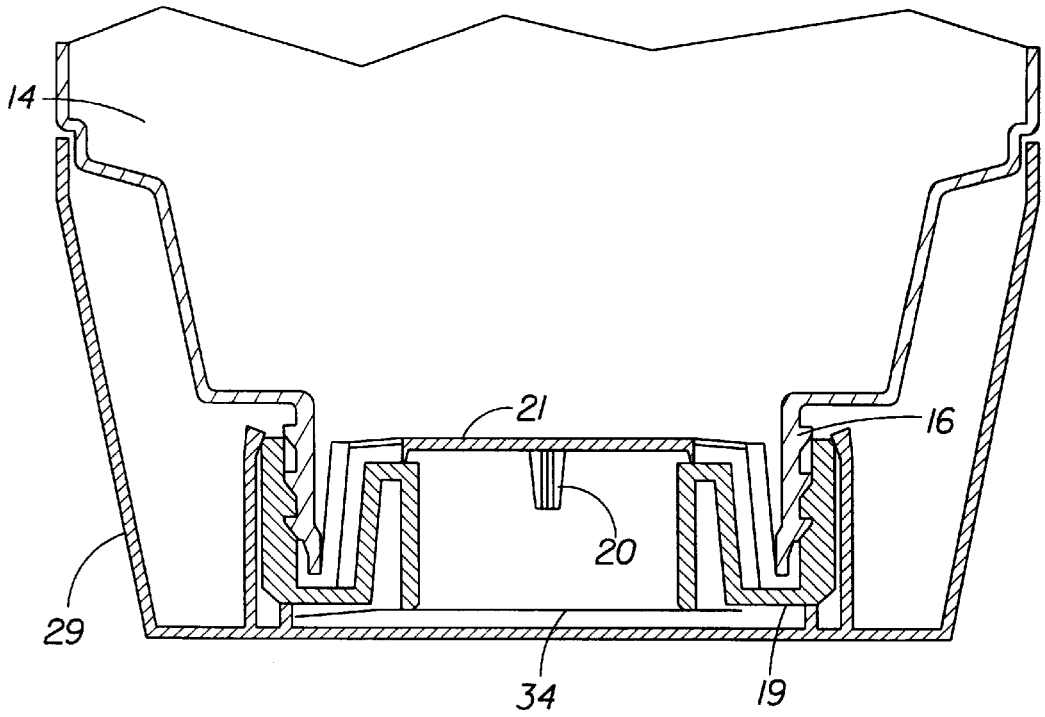
FIG. 4 is a partial cross-sectional view of the recharge finish area of the preferred rechargeable dispensing system according to the present invention.

Referring to FIG. 4, the preferred recharge container 11 has a snap-on cover 29 attached to the bottle finish 16 and a foil seal 34 attached to the bottle cap 19 which protect the spiral valve 21 from outside elements. In addition, the cover 29 and foil seal 34 prevent moisture from contaminating the product while on the shelf or in storage.

The operation of the preferred rechargeable dispensing system 10 requires the removal of the snap-on cover 39 and the foil seal 40 from the recharge container 11. The primary finish 16 of the recharge container 11 is inserted vertically into the receptacle 22 of the base 12. As the recharge container 11 is inserted, the valve post 20 on the back of the spiral valve 21 pushes the base seal 27 open by compressing the return spring 28, thus creating a product flow path (i.e. open communication) between the recharge container 11 and the pump 13. The O-ring seal 26 in the receptacle 22 engages the internal diameter of the bottle cap 19 and creates a liquid tight seal between the bottle cap 19 and the base 12 before the spiral valve 21 is opened. The insertion of the recharge container 11 continues until the bottle cap 19 engages the inside bottom surface 33 of the receptacle 22 in the final docked but unlocked position.

To lock the recharge container 11 to the base 12, the clip actuator 35 is rotated such that the camming surfaces 37 push the fingers 38 of the finger ring 36 into the finish recess 18 of the bottle 14. The recharge container 11 will remain locked to the base 12 as long as the camming surfaces 37 engage the fingers 38 by forcing the fingers 38 toward the primary finish 16 and into the finish recess 18. To unlock the bottle 14, the clip actuator 35 is rotated such that the camming surfaces 37 disengage the fingers 38 which allows the fingers 38 to relax away from the primary finish 16 and disengage the finish recess 18. The recharge container 11 is unlocked from the base 12 and capable of being removed and transported. This permits the empty recharge container 11 to be replaced with a recharged (i.e., full) container 11.

The drip cup 30 is positioned inside the receptacle 22 to capture any excess product that might drip out of the recharge container 11 as it is removed from the base 12. In addition, the drip cup 30 is snapped into the receptacle 22 for easy removal and cleaning.

Figure 5:
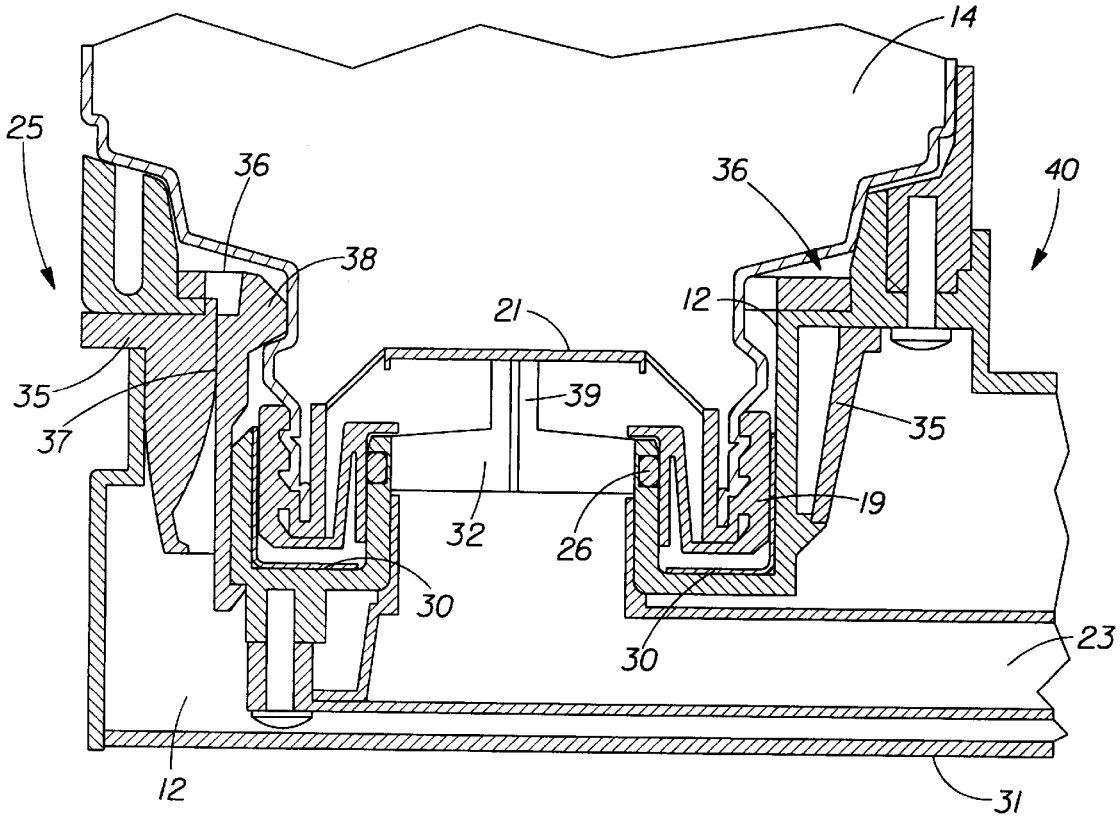
FIG. 5 is a partial cross-sectional view of an alternate rechargeable dispensing system in a docked state according to the present invention.
Figure 6:
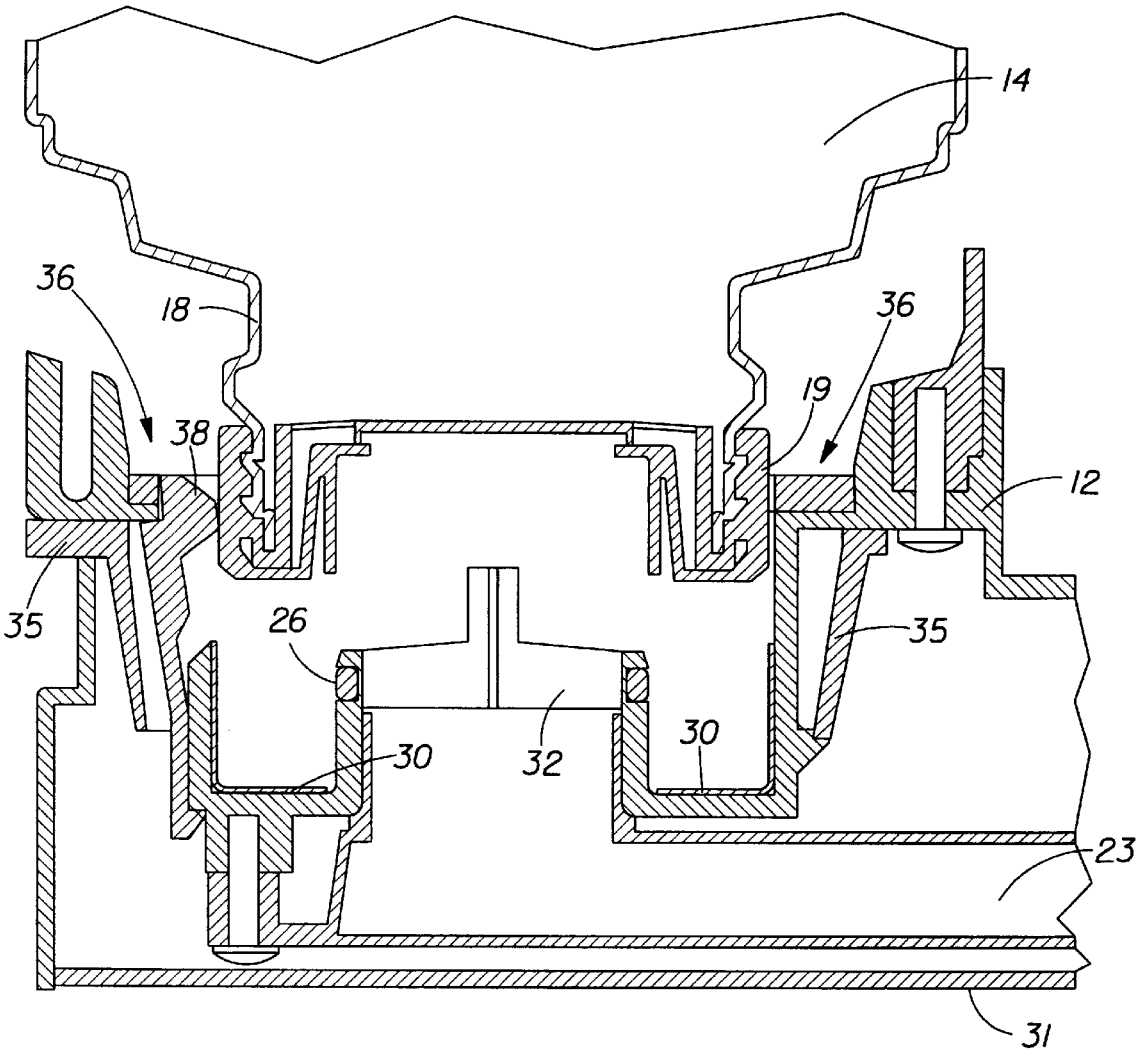
FIG. 6 is a partial cross-sectional view of an alternate rechargeable dispensing system in an undocked state according to the present invention.

Referring to FIGS. 5 and 6, an alternate rechargeable dispensing system 40 is shown in a docked position (FIG. 5) and an undocked position (FIG. 6). The alternate rechargeable dispensing system 40 is the same in structure and operation as illustrated in FIGS. 1 and 2 except that the alternate recharge container 11 does not have the valve post 20, the moveable base seal 27 or the return spring 28.

Instead, the base 12 of the alternate system 40 utilizes a fixed base seal 32 to activate the valve 21.

As the recharge container 11 is inserted into the receptacle 22, a base post 39 of the fixed base seal 32, which is attached to the receptacle 22, pushes the spiral valve 21 open and creates the necessary product flow path between the recharge container 11 and the pump 13. However, the rechargeable dispensing system 10 of FIGS. 1–4 with the return spring 28 and the base seal 27 is preferred because it provides a closed rechargeable dispensing system 10 which minimizes the opportunity for product contamination with water when the recharge container 11 is removed from the base 12.

In operation, gravity will assist the movement of the product out of the alternate rechargeable dispensing system's 40 recharge container 11 and into the fluid connector 23 until a pressure equilibrium is achieved between the container 11 and the fluid connector 23. The fluid connector 23 serves as a product reservoir as well as an air tight passageway between the pump 13 and the recharge container 11.

Figure 7:
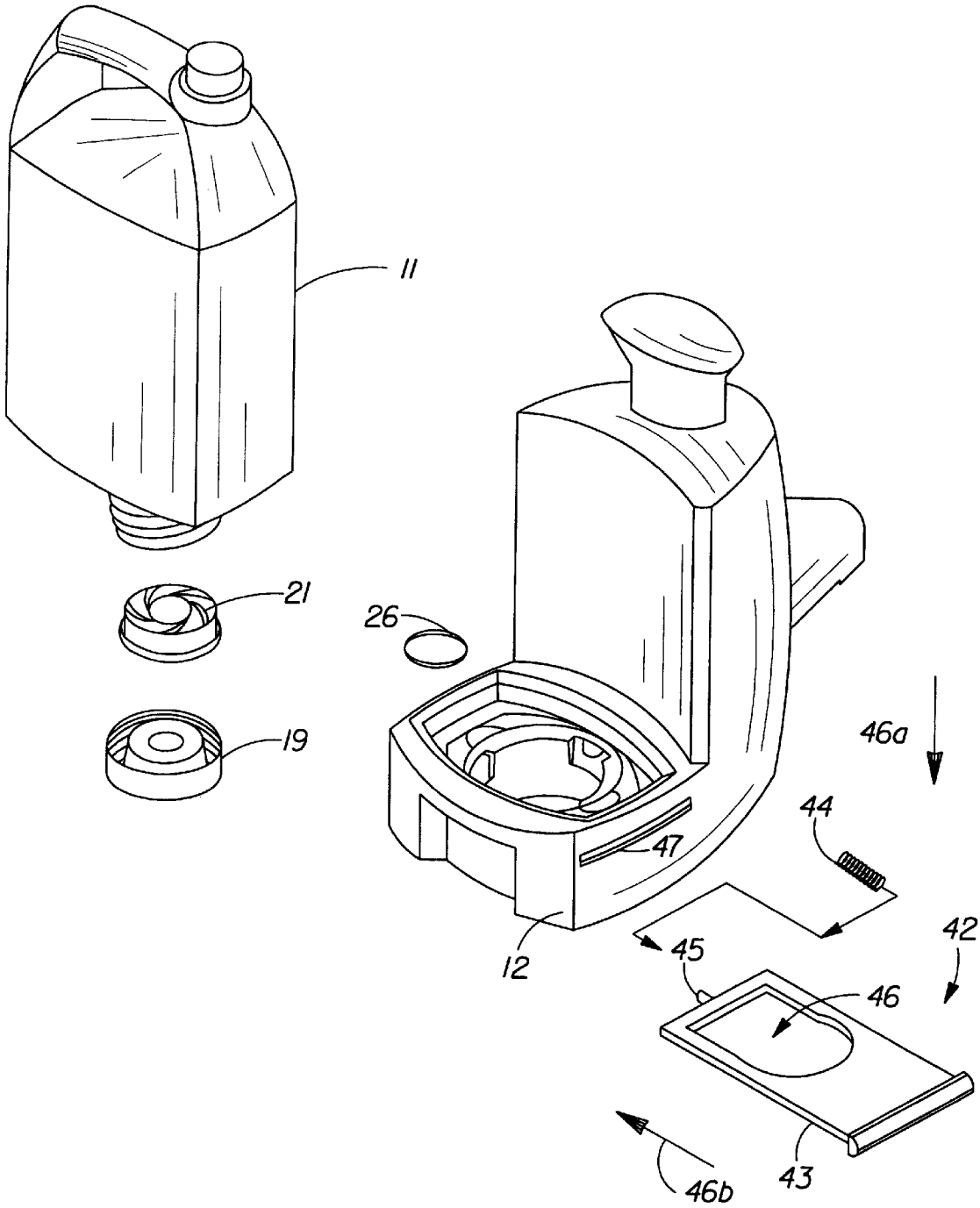
FIG. 7 is a perspective assembly drawing of an alternate slide clip actuator with a bias to a locked position according to the present invention.

Referring to FIG. 7, an alternate docking mechanism 42 is shown in an assembly drawing and comprises a slide clip actuator 43, a bias spring 44, a spring post 45 for receiving the bias spring 44, a slide clip key hole 46 and a slot 47.

In operation, the primary finish 16 of the bottle 14 is inserted in a vertical direction 46*a* through the slide clip key hole 46. As the slide clip actuator 43 is moved in an axial direction 46*b*, the slide clip actuator 43 lockingly engages the finish recess 18. The slide clip actuator 43 is attached to the base 12 and is held in a locked position by the pressure exerted by the bias spring 44.

Figure 8:
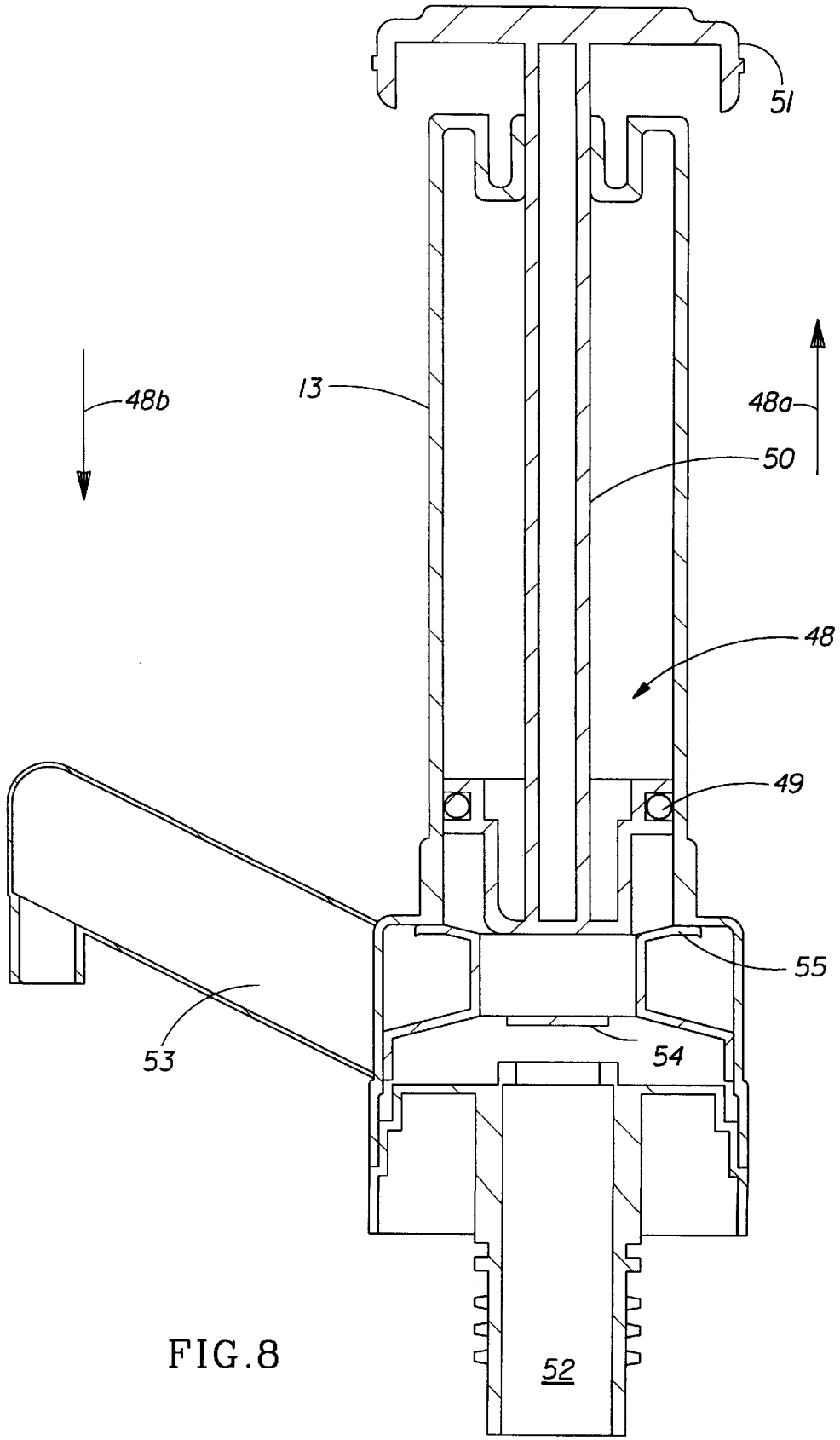
FIG. 8 is a cross-sectional view of the preferred piston pump assembly according to the present invention.

Referring to FIG. 8, the pump 13 can be any type of pump capable of pumping a highly viscous liquid such as laundry treatment products, particularly a new type of anhydrous (solvent-based) thick cream-like laundry detergent product having at least 40% suspended solids, a specific gravity of 1.2 and a viscosity range of between 1000 to 3500 centipoise. However, the preferred pump 13 is an injection molded fixed-nozzle piston-and-cylinder type pump made primarily for dispensing viscous liquids such as laundry treatment products by manual operation.

The preferred pump 13 comprises a piston 48 and a piston seal 49 having a plunger 50 which is activated manually using a handle 51. The pump 13 has an inlet 52 which receives the product and a discharge spout 53 for dispensing the product. The product flow is controlled through the pump via an inlet valve 54 and an outlet valve 55. The preferred pump is a manual piston-and-cylinder pump but may comprise a variety of pumps available in the industry but preferably comprises, for example, piston and cylinder pumps manufactured by Englass Packaging and Dispensing Systems, Inc., such as FND 30, MAXI and MAJOR piston pumps.

In operation, the piston 48 is drawn in an upward direction 48*a* by activating the handle 51 which pulls the product through the one way valve 54 into the pump cylinder. The handle 51 is then pushed in a downward direction 48*b* which pushes the piston down and forces the product out of the one way outlet valve 55 and through the discharge spout 53. The preferred pump 13 is an airless system in that an air vent is not provided within the pump 13. In addition, the pump 13 can be integrated into the platform base 12 as a single piece or attached to the base. Alternately, the pump 13 may be an electric pump or a battery operated pump without deviating from the intent of the invention.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A container for use with a docking station adapted to receive said container, said container comprising:

a) a handle;

b) a primary finish comprising a finish recess; and c) a spiral valve associated with said primary finish such that an interior volume of said container is defined by said spiral valve and said primary finish, said spiral valve being adapted such that the interior volume of said container is in fluid communication with said docking station through said spiral valve when said container is received in said docking station.

2. The container of claim 1, wherein said valve is a spiral valve having a plate attached to a ring with at least three shape memory bands, said post displacing said plate when the container engages the receptacle.

3. The container of claim 1, wherein said container further comprises a liquid having at least 40% suspended solids.

4. The container of claim 1, further comprising a second finish having a vent.

5. A rechargeable dispensing system comprising:

a) a container according to claim 1; and b) a docking station comprising a receptacle adapted to receive said container, a locking mechanism to secure said container to said docking station; and c) a discharge spout in fluid communication with said docking station;

wherein said valve in said container is opened such that the interior volume of said container is in fluid communication with said receptacle of said docking station through said valve when said container is received in said receptacle of said docking station.

6. A rechargeable dispensing system, comprising:

a container having a primary finish with a recess;

a docking station having a receptacle for receiving said container, a locking mechanism for securing said container to said docking station, wherein said locking mechanism includes a rotatable actuator positioned within said receptacle having at least one camming surface and a ring positioned within said actuator having at least one finger, and wherein said camming surface engages said finger when said actuator is rotated so that said finger is biased into engagement with said recess of said container to secure said container to said docking station; and a discharge spout in fluid communication with said receptacle.

7. The recharge dispensing system of claim 6, wherein said container further comprises a liquid having at least 40% suspended solids.

8. The recharge dispensing system of claim 7, wherein said liquid has a viscosity of between 1000 centipoise and 3500 centipoise.

9. The recharge dispensing system of claim 8, wherein said liquid is an anhydrous laundry detergent.

10. The recharge dispensing system of claim 6, wherein said receptacle further comprises a spring-biased seal which is opened by said container when said container engages said receptacle.

11. The recharge dispensing system of claim 10, wherein said container further comprises a valve having a post, wherein said post engages said seal to open said seal when said container engages said receptacle.

12. The recharge dispensing system of claim 11, wherein said valve is a spiral valve.

13. The recharge dispensing system of claim 12, wherein said spiral valve comprises a plate attached to a ring with at least three shape memory bands, said post displacing said plate when said container engages said receptacle.

14. The recharge dispensing system of claim 6, wherein said receptacle further comprises a post for opening a valve of said container when said container engages said receptacle.

15. The recharge dispensing system of claim 14 wherein said valve is a spiral valve.

16. The recharge dispensing system of claim 15 wherein said spiral valve comprises a plate attached to a ring with at least three shape memory bands.

17. The recharge dispensing system of claim 6, wherein said container further comprises a secondary finish having a vent.

18. The recharge dispensing system of claim 6, further comprising a pump in fluid communication with said discharge spout and said receptacle.

* * * * *